US007056068B2

(12) United States Patent
Kadiu

(10) Patent No.: US 7,056,068 B2
(45) Date of Patent: Jun. 6, 2006

(54) TRENCH SHORING SYSTEM

(76) Inventor: Max Kadiu, 19694 Auburn Dr., Cupertino, CA (US) 95014

( * ) Notice: Subject to any disclaimer, the term of this patent is extended or adjusted under 35 U.S.C. 154(b) by 0 days.

(21) Appl. No.: 10/945,235

(22) Filed: Sep. 20, 2004

(65) Prior Publication Data

US 2005/0074301 A1 Apr. 7, 2005

Related U.S. Application Data

(63) Continuation of application No. 10/678,480, filed on Oct. 3, 2003.

(51) Int. Cl.
*E02B 17/00* (2006.01)

(52) U.S. Cl. ..... 405/282; 405/272

(58) Field of Classification Search ..... 405/272, 405/282

See application file for complete search history.

(56) References Cited

U.S. PATENT DOCUMENTS 3,910,054 A * 10/1975 Krings ..... 405/282
3,937,026 A * 2/1976 Krings ..... 405/282
4,054,033 A * 10/1977 Pillosio ..... 405/282
4,145,891 A * 3/1979 Krings ..... 405/282
4,657,442 A * 4/1987 Krings ..... 405/282
5,310,289 A * 5/1994 Hess ..... 405/282
5,931,607 A * 8/1999 Hess ..... 405/282
6,164,874 A * 12/2000 May ..... 405/282

* cited by examiner

*Primary Examiner*—Frederick L. Lagman

(57) ABSTRACT

A shoring system for trenches comprising large shoring panels and strutting assemblies is disclosed. Shoring panels are arranged in pairs against either wall of the trench and held vertically by adjacent strutting assemblies spaced apart along the trench. Each strutting assembly has at least one horizontal strut fastened in between a pair of opposite vertical struts. Each said vertical strut has laterally opposite guide channels to receive cooperatively the guide edge of the shoring panel that slides vertically within. Each guide channel of said vertical strut is provided with a locking bar to interlock the guide edge of the shoring panel so that pairs of shoring panels are linked successively on either side of a strutting assembly to create a shoring wall on either side of the entire trench. Said vertical strut is further provided with pairs of rollers to ease sliding of shoring panels. In one variation, the strutting assembly comprises at least one hydraulic cylinder to push apart opposite vertical struts forcing shoring panels to exert a pressure load against either wall of the trench.

10 Claims, 9 Drawing Sheets

TRENCH SHORING SYSTEM

CROSS-REFRENCE TO RELATED APPLICATIONS

This is a continuation of application of U.S. patent application Ser. No. 10/678,480, filed Oct. 3, 2003.

TECHNICAL FIELD

This invention relates to apparatuses for shoring trenches or other open excavations.

BACKGROUND OF THE INVENTION

This invention relates to shoring systems for trenches. The shoring system comprises large shoring panels and strutting assemblies. Each shoring panel has laterally, on either end, a guide edge. The strutting assembly consists of a pair of vertical struts held oppositely apart by at least one horizontal strut. Each vertical strut of strutting assembly has lengthwise, laterally on either side, a U-shaped guide channel to receive cooperatively the guide edge provided on either end of each shoring panel.

The panels are arranged in pairs alongside the trench and held vertically parallel against either wall of the trench by a pair of strutting assemblies. Each strutting assembly slides on the opposite ends of the pair of panels. Several pairs of panels are successively connected by strutting assemblies creating a long shoring wall on either side of the trench.

Normally, the components of the shoring system are assembled together during first stage of excavation, up to 4 ft. deep. To begin with, one strutting assembly is installed in the trench having each vertical strut pressing respectively against either wall of the trench while the horizontal strut is maintained perpendicular to longitudinal axis of trench. A shoring panel slides within guide channel of each vertical strut pressing against respective wall of the trench. On the free end of each shoring panel slides the respective vertical strut of a second strutting assembly creating thereby a two sided shoring box called a shoring module. Afterward, each component of the shoring module is pushed down evenly as excavation progresses. Successive shoring modules are interconnected to shore the required length of the open trench. Normally, at one end of the trench (excavation section), a new shoring module is in installation process while at the other end (backfill section), a shoring module is in process to be removed from the ground. Hence, the shoring modules are moved along the trench from the backfill section to the excavation section in a leapfrog scheme.

There are several shoring devices used for securing the walls of open excavations and the working space inside it. A such shoring device, commonly called trench shield, has usually two panels held by individual spreaders pinned or bolted onto the extremities of each panel via flanges or fixed connectors. Principally, these devices are rigid in a sense that they do not allow relative movement between spreaders and panels and most of the time their installation is achieved after excavation.

Other types of shoring device, commonly called slide rail shoring systems, have a plurality of pairs of opposite rails spaced along the trench so that each pair of rails is supported by a strutting frame sliding in between them. Each rail support is provided on either side with guide channels where edges of large shoring panels slide interlocked within so that every two adjacent rails are connected with at least one shoring panel. Slide rails shoring system is currently used in the construction projects despite aversion in costs, weight and structural damages during utilization.

Knowing shoring device that has panels sliding vertically within excavation without using vertical support columns is disclosed in U.S. Pat. No. 6,224,296 (Fukumori). This device uses two pairs of large shoring panels. The first pair of panels, which shores the upper part of trench pressing against the excavation walls, is fixed at ground level. The second pair of panels slides within first pair shoring thereby the lower part of excavation. Both pairs of panels are connected and use sets of rigging to control the installation and removal of this device. Such device performs poorly in deep excavation and requires accurate installation regarding the space between first pair of panels their parallelism, etc. The removal of the panel is also associated with damages of guiding pair of panels.

U.S. Pat. Nos. 3,910,053 and 4,657,442 (Krings), U.S. Pat. Nos. 5,310,289 and 5,503,504 (Hess et al.), U.S. Pat. No. 6,164,874 (May) disclose various slide rail shoring system, all of them including multiple pairs of columns, spreader systems and large shoring panels. The support columns and the spreader systems used with these shoring systems are very heavy and are often hammered to push it down which often results with strong damages and heavy costs in maintenance.

BRIEF SUMMARY OF THE INVENTION

Substantially, the intent of present invention is to provide a shoring device of type described above that allows shoring panels to slide independently to each other so that the device could be lowered progressively as excavation progresses while supporting the excavation walls.

Pursuing this objective and others that will be explicit subsequently, one important aspect of the present invention resides on design of a strutting assembly that slides vertically formlockingly along the guides of shoring panels accommodating different pipe culverts and securing the soils surrounding the excavation while protecting the working space inside it.

The very important aspect of this shoring system is the invention of a shoring module consisting of basically only two components, shoring panels and strutting assemblies; each component sliding vertically relative to the other at discard of heavy and cumbersome vertical rail posts.

Yet another important factor of this invention is its modular aspect. Several shoring modules are linked successively to shore the entire trench when necessary.

The new features considered as characteristic for the invention are set forth in the appended claims. Other advantages of the invention will be appreciated in view of the following description and drawings.

DETAILED DESCRIPTION OF THE INVENTION

Figure 1:
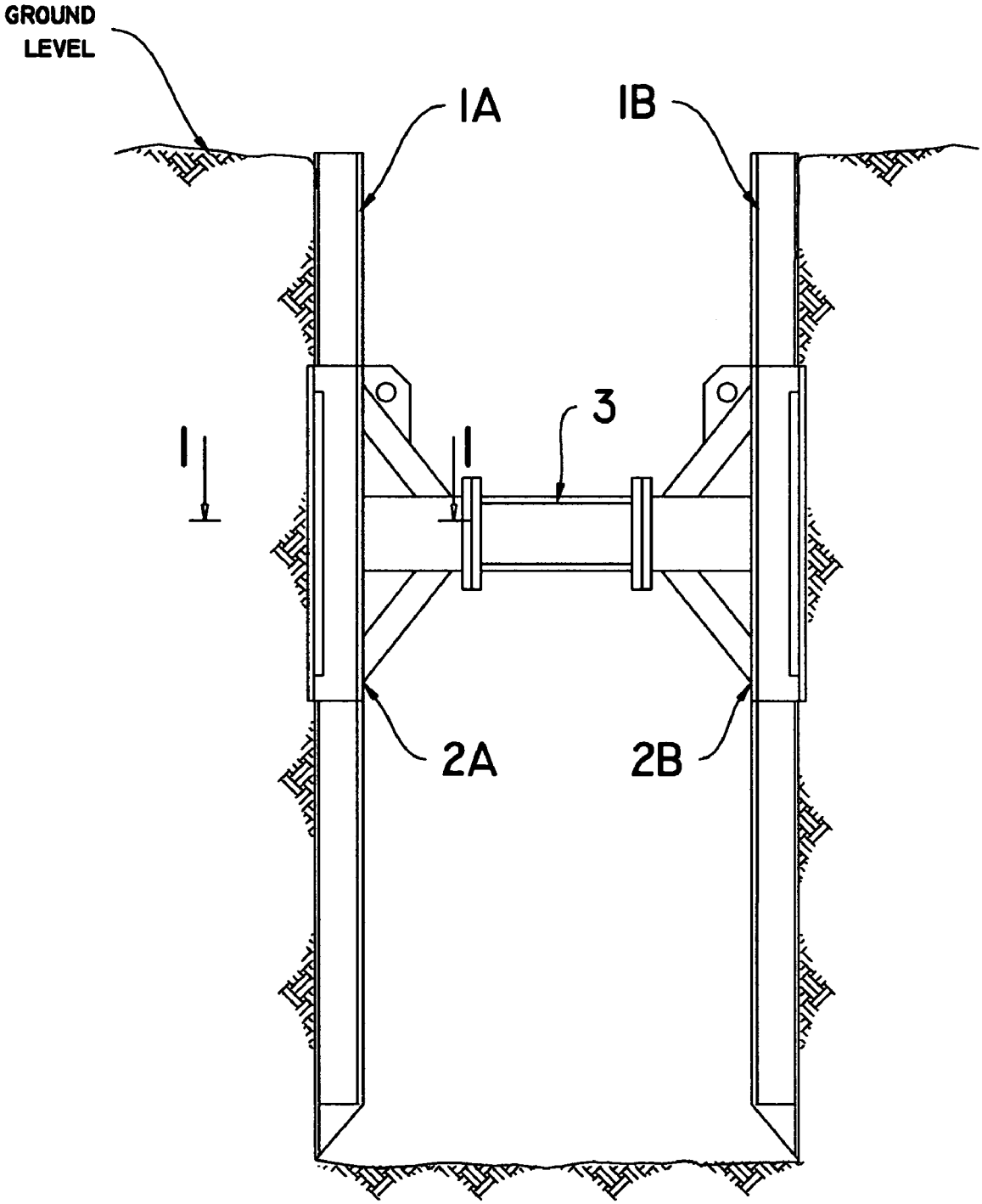
FIG. 1 is a sectional view of a trench showing two shoring panels held by a strutting assembly.
Figure 2:
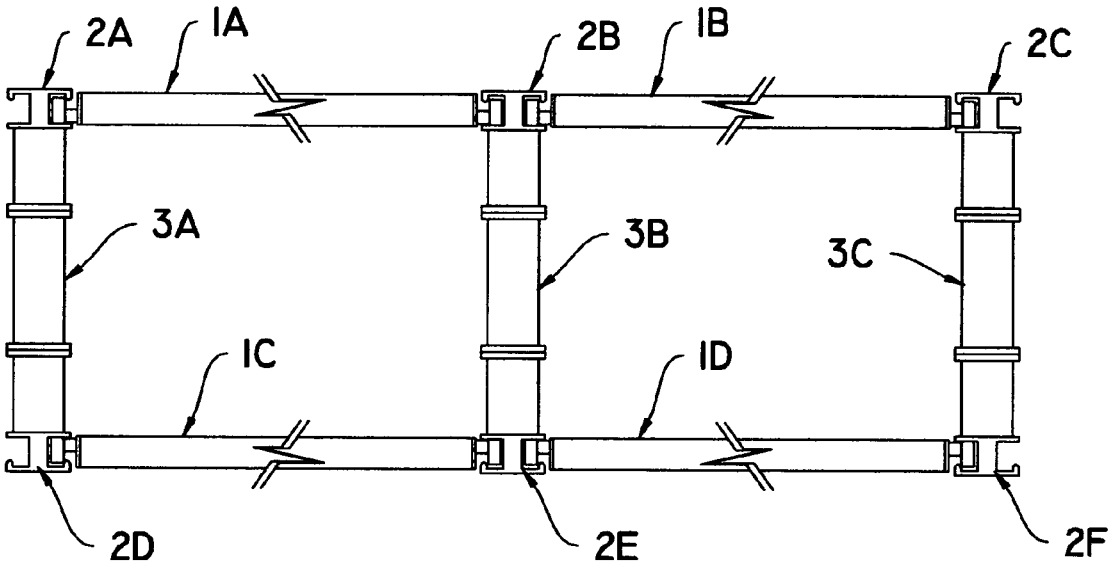
FIG. 2 is a top view of the shoring system showing panels and strutting assemblies as installed in a trench.

Referring to the drawings where like numerals indicate like elements, various embodiments incorporating the new features of the present invention are illustrated. FIG. 1 illustrates two shoring panels 1A, 1B held vertically parallel by the vertical struts 2A, 2B, which are kept apart by a horizontal strut 3. The vertical struts 2A, 2B and the horizontal strut 3 form together a strutting assembly. FIG. 2 shows a top view of an arrangement of vertical struts 2A, 2B, 2C, 2D, 2E, 2F of strutting assemblies and shoring panels 1A, 1B, 1C and 1D creating two shoring modules. The strutting assembly comprising vertical struts 2B, 2E and horizontal strut 3B partake on both modules.

Figure 3:
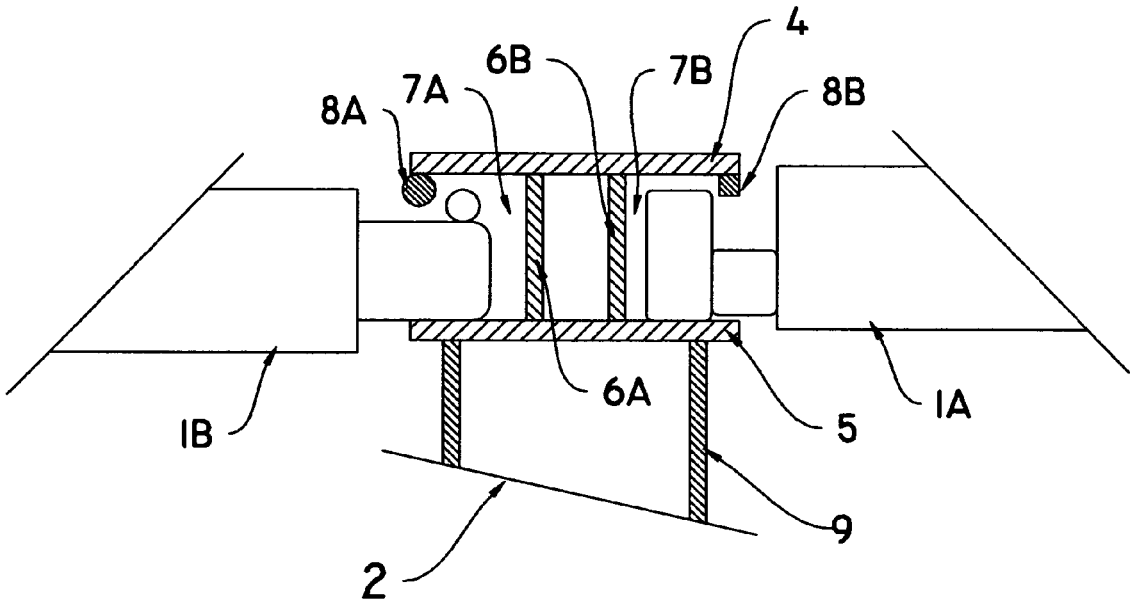
FIG. 3 is a sectional view taken along the line I—I of the FIG. 1, showing the cross section of a vertical strut of the strutting assembly.
Figure 4:
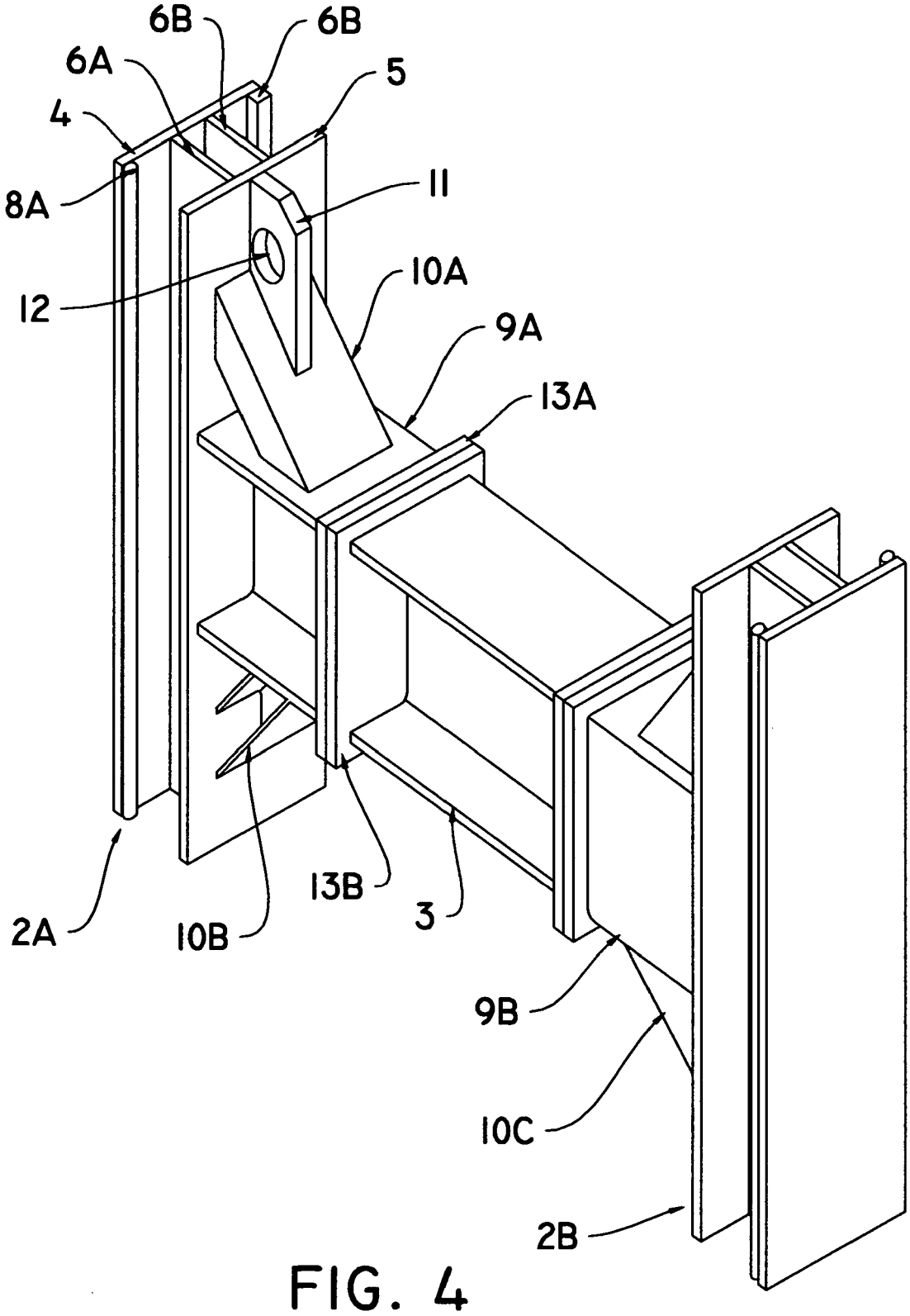
FIG. 4 is a three dimensional view of the strutting assembly.

As shown in the FIG. 3, the vertical strut 2 has a back flange 4 to press against the trench wall, a front flange 5 and two lateral flanges 6A, 6B, which are spaced apart and held parallel in between back flange 4 and front flange 5 to form U-shaped guide channels 7A, 7B on opposite sides of vertical strut 2 for receiving the guide edges of shoring panels 1A, 1B. Locking bars 8A, 8B of round or rectangular cross section are welded inward on either lip of the back flange 4 to interlock the panels 1A, 1B within the respective guide channels 7A, 7B. On the front flange 5 is welded a connector piece 9 projecting inward the trench. As shown in the FIG. 4, the connector piece 9A is fastened onto the horizontal strut 3 by bolts (not shown) via contact flanges 13A, 13B or by pins (not shown). The connector piece 9A could be of any structural shape like beam 9A, tube 9B, pipe or combination of flat bars or others (not shown). Several reinforcing pieces 10A, 10B, 10C of any structural shape like tube, beam, plates, are optional to strengthen the vertical strut 2A, 2B. A lifting piece of type plate 11 with a hole 12 is welded on the upper end of each vertical strut 2A and 2B. Other types of lifting piece may be used (like 11B in FIG. 10).

Figure 5:
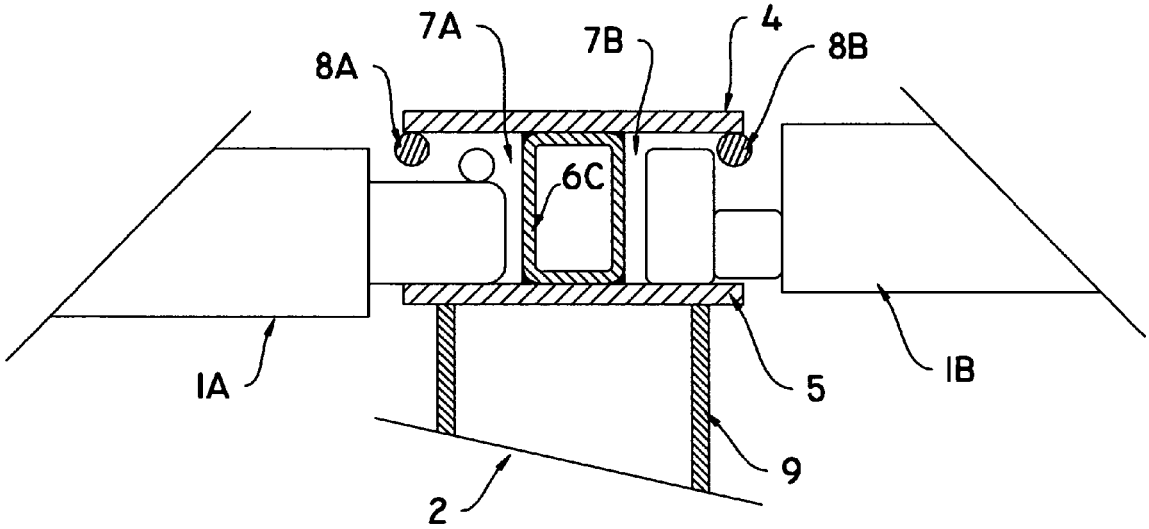
FIG. 5 is a sectional view of the vertical strut of strutting assembly showing a variation of its structural elements.
Figure 6:
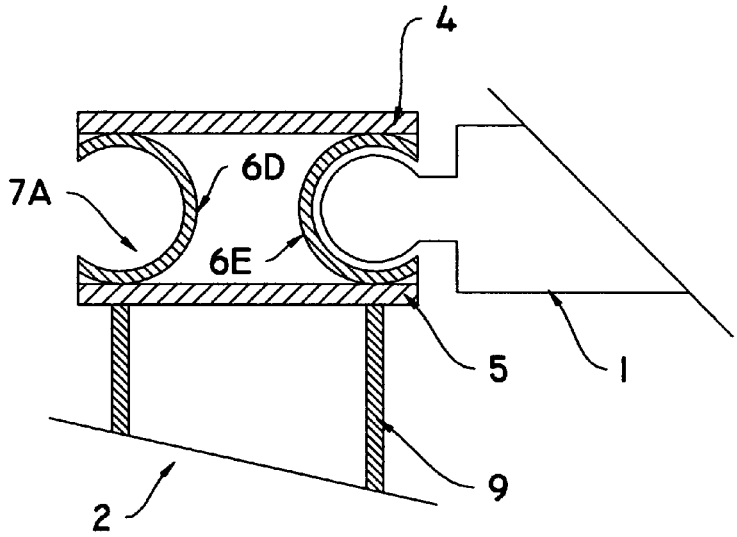
FIG. 6 is a sectional view of the vertical strut of strutting assembly showing yet another variation of its structural elements.

FIG. 5 shows a variation of vertical strut 2 wherein the role of lateral flanges 6A, 6B is secured by a structural tube 6C. As shown in FIG. 6 yet another variation of the vertical strut 2 is obtained by using as lateral flanges two circular sections of 6D, 6E.

Figure 7:
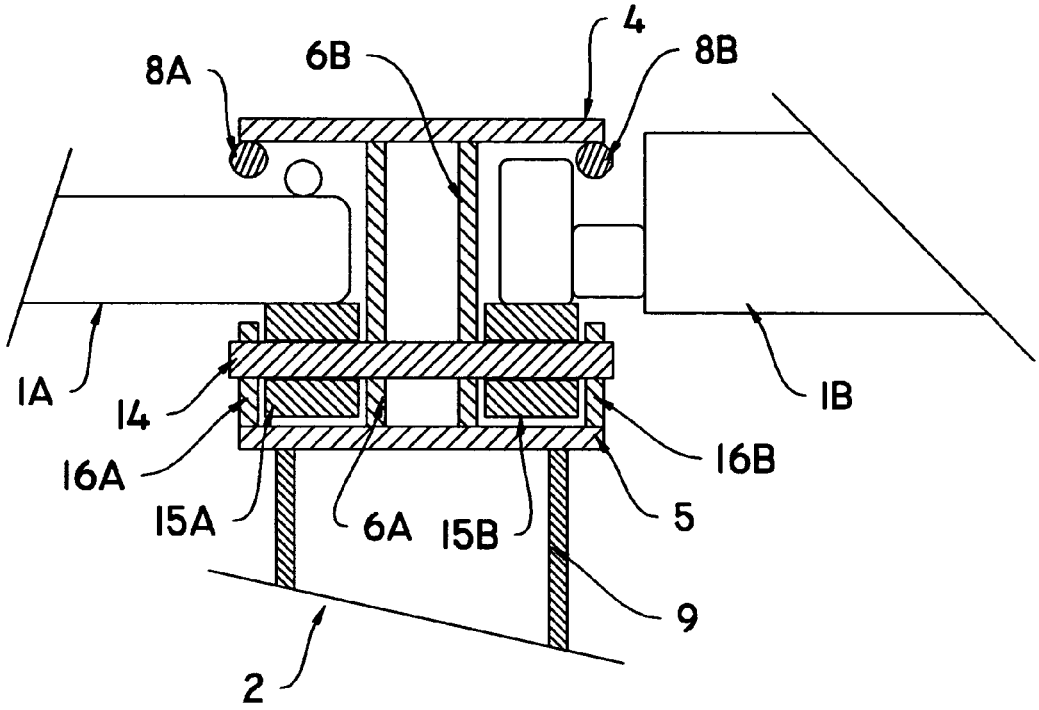
FIG. 7 is a sectional view showing the cross section of a vertical strut of strutting assembly provided with rollers.

FIG. 7 illustrates a sectional view of a vertical strut 2 provided with a pair of rollers 15A, 15B held by the axle 14 fixed into supporting plates 16A, 16B and lateral flanges 6A, 6B. Although axle 14 is preferred continuous, it could be interrupted in between lateral flanges 6A, 6B (not shown). Normally, at least two pairs of rollers 15A, 15B are provided respectively near to the upper end and the lower end of each vertical strut 2.

Figure 8:
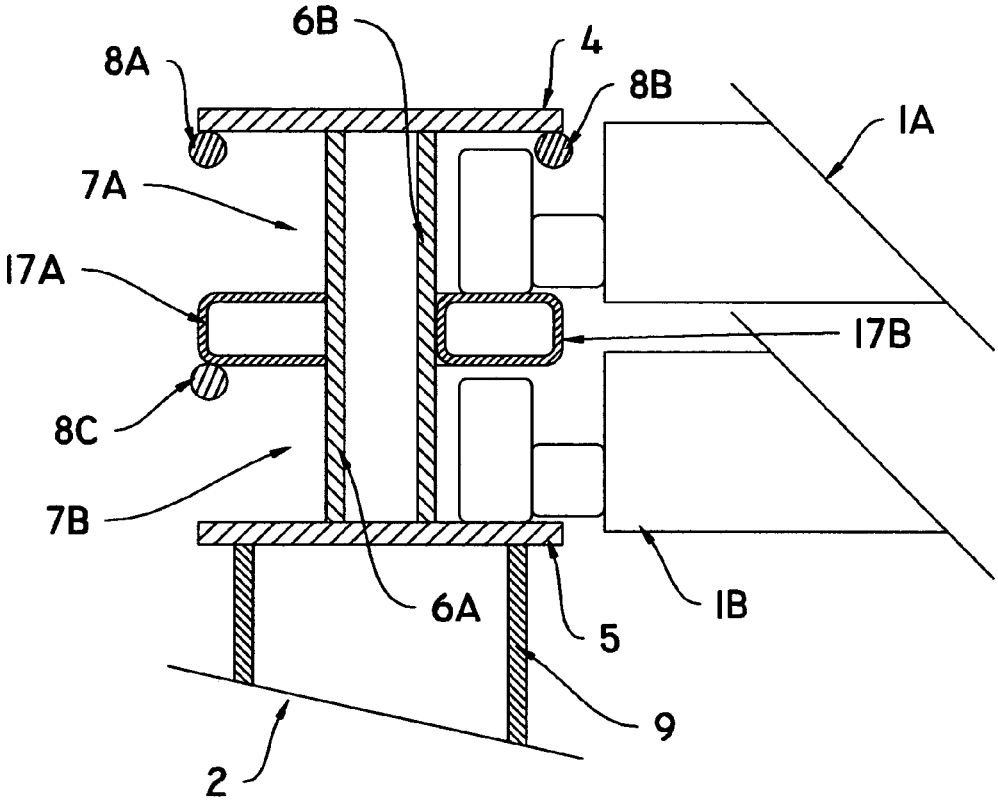
FIG. 8 is a sectional view showing the cross section of a vertical strut of strutting assembly provided on either side with two guide channels allowing two shoring panels to slide past each other.

FIG. 8 illustrates another variation of a vertical strut 2 having two guide channels 7A, 7B separated respectively by the separator pieces 17A, 17B welded respectively onto lateral flanges 6A, 6B at equal distance from back flange 4 and front flange 5. Hence, shoring panels 1A, 1B slide past each other to create a stepped shoring wall. This is useful in deep excavations, where one shoring panel can not cover the entire height of the trench. An optional locking bar 18C is welded flash onto separator piece 17A.

Figure 9:
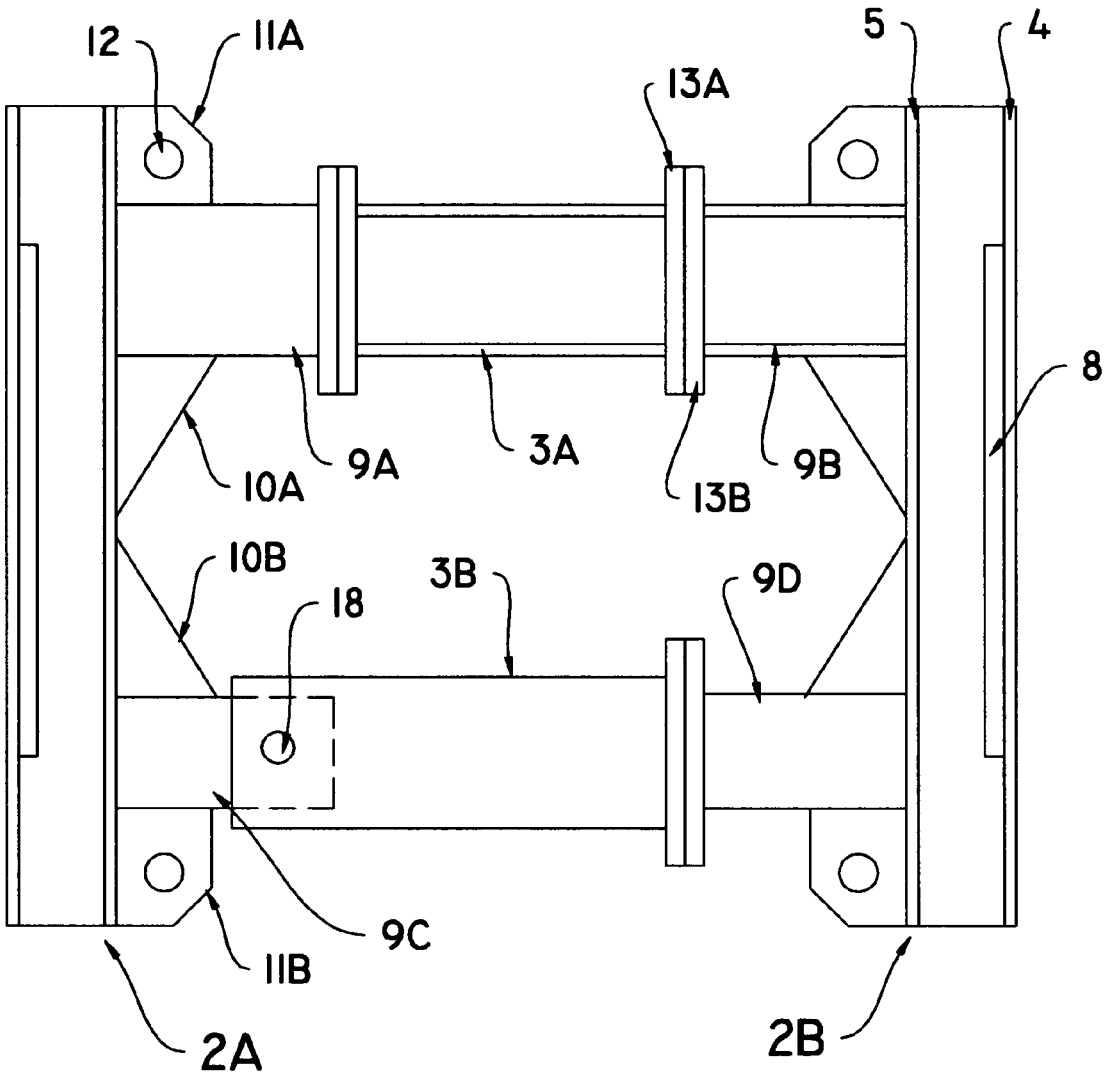
FIG. 9 is a side view of a strutting assembly having two horizontal struts.

FIG. 9 illustrates a strutting assembly having an upper horizontal strut 3A and a lower horizontal strut 3B. Various types of connection are possible between components. In one variation, the horizontal strut 3A joins the connector pieces 9A, 9B via contact flanges 13A, 13B and bolts (not shown). In another variation, the horizontal strut 3B joins the connector piece 9C via pin 18.

Figure 10:
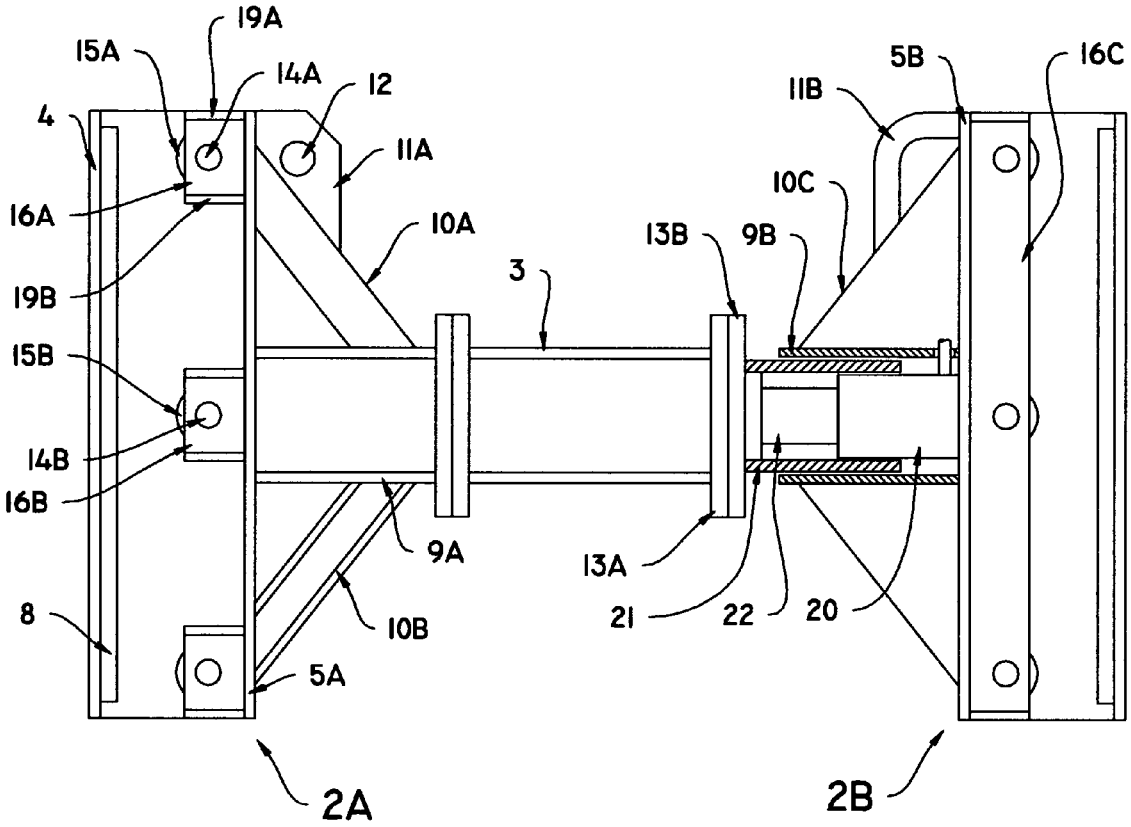
FIG. 10 is a side view of strutting assembly provided with a hydraulic cylinder pressing on either vertical strut.

FIG. 10 illustrates a side view of a strutting assembly having vertical struts 2A, 2B provided with rollers like 15A, 15B. In one variation, individual supporting plates 16A, 16B holding the axles 14A, 14B are provided for rollers 15A, 15B. In another variation, a supporting plate 16C is employed for all the rollers located on one side of vertical strut 2B. Optionally, cover plates 19A, 19B are provided above and below roller 15A. At least one vertical strut 2B is further provided with a hydraulic cylinder 20 lodged within connector piece 9B and sleeve 21 protecting the shaft 22. The cylinder 20 is fastened onto front flange 5B while the shaft 22 is fastened onto contact flange 13B. However, reverse orientation of cylinder 20 within the connector piece 9B is well conceivable. The hydraulic cylinder serves to push apart opposite vertical struts 2A, 2B forcing shoring panels to exert a pressure load against either wall of the trench.

Figure 11:
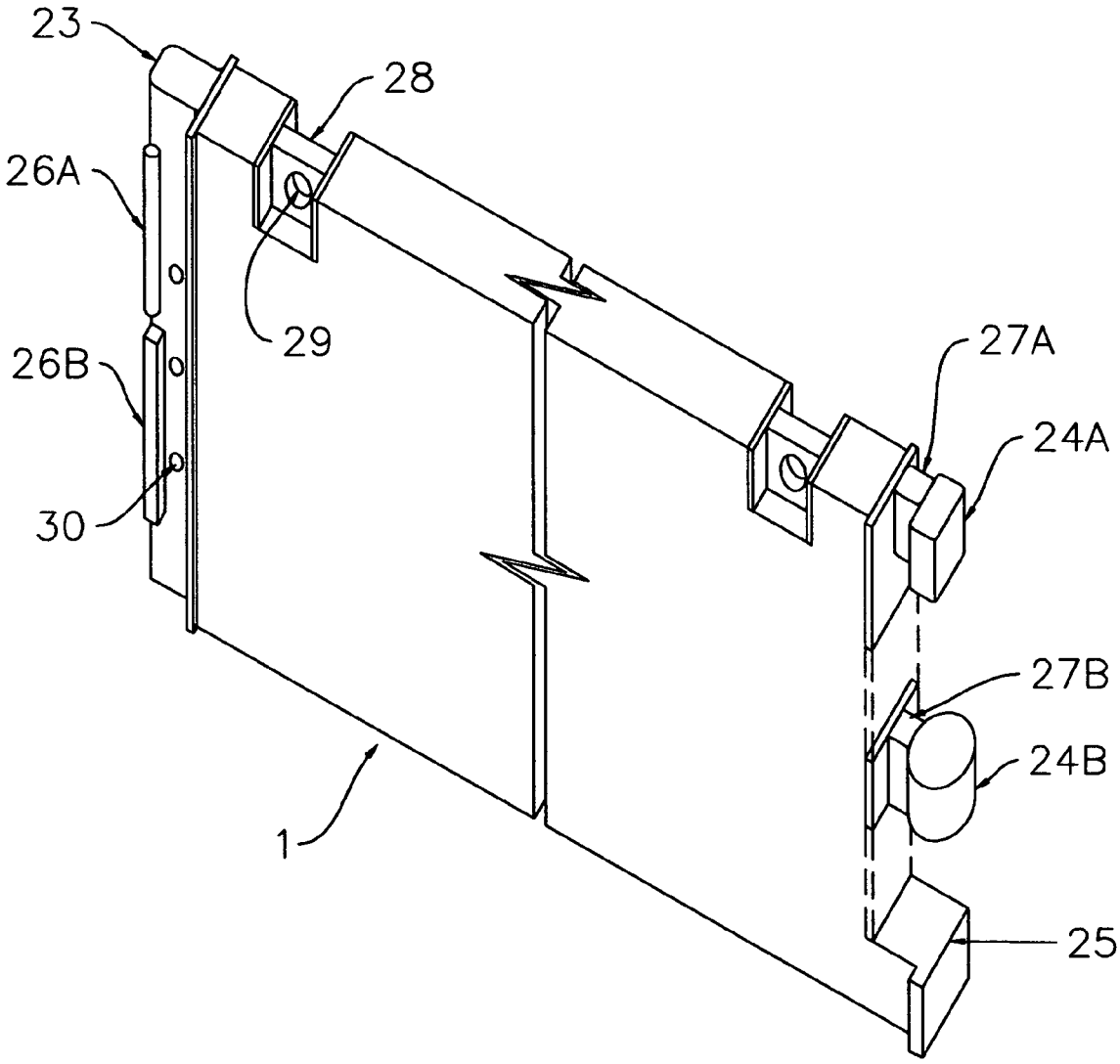
FIG. 11 is a three dimensional view of a shoring panel.

As shown in FIG. 11 shoring panel 1 has laterally on either side a guide edge like 23, 24A, 24B or 25. According to the type of guide edge, locking bars 26A or 26B, respectively of round or rectangular cross section, are provided or the spacing bodies 27A or 27B. The L-shaped guide edge 25 is an abstraction of possible combinations of various structural shapes to conceive a guide edge that would interlock within guide channel of vertical strut (not shown). The panel 1 is provided with lifting plates 28 having a hole 29. Optionally, on or more pin holes 30 are provided in the panel to insert stopping pins blocking the strutting assembly in different heights of shoring panel. Additional features of the panel 1 that are not relevant to the invention are not shown.

I claim:

1. A shoring system comprising strutting assemblies and shoring panels wherein:

a) each said strutting assembly having a pair of vertical struts held oppositely apart by at least one horizontal strut, each said vertical strut being rigidly fastened on either end of said horizontal strut so that said horizontal strut does not pivot nor can move vertically relative to said vertical strut, each said vertical strut having opposing sides, each said opposing side having a guide channel, each said guide channel being adapted to engage partially and interlock said shoring panels sliding vertically within;

b) each shoring panel having laterally on either end a guide edge to be engaged partially within said guide channel of said vertical strut of said strutting assembly, each said guide edge of said panel being further adapted to cooperatively interlock but slide vertically within said guide channel of said vertical strut of said strutting assembly.

2. The shoring system of claim 1 wherein said strutting assembly has a pair of said vertical struts and at least one said horizontal strut so that:

said vertical strut having a back flange to press against trench wall and a front flange holding perpendicularly in between two spaced apart lateral flanges, said back flange and said front flange projecting oppositely outward said lateral flanges to create on each opposing side of said vertical strut a guide channel;

each said guide channel having a locking bar of round or rectangular cross section welded inward onto either lip of said back flange to interlock said shoring panels sliding within;

said vertical strut further having at least one connector piece to fasten onto the side of a said horizontal strut.

3. A shoring system as set forth in claim 2 wherein said lateral flanges of said vertical strut are replaced by a structural tube.

4. A shoring system as set forth in claim 2 wherein said vertical strut being provided with at least one lifting piece.

5. A shoring system as set forth in claim 2 wherein said connector piece being reinforced with stiffeners of any type of structural shapes or plates.

6. A shoring system as set forth in claim 2 wherein said lateral flanges are replaced by two circular flanges shaping guide channels of circular cross section without the use of said locking bars.

7. A shoring system as set forth in the claim 2 wherein said vertical strut is provided with rollers.

8. A shoring system as set forth in the claim 2 wherein said vertical strut being provided with a separator piece welded onto said lateral flange shaping thereby two guide channels on each opposing side of said vertical strut, said separator piece being quasi equidistant from said back flange and said front flange.

9. A shoring system as set forth in the claim 2 wherein said strutting assembly has two said horizontal struts fastened on either side onto a said vertical strut.

10. A shoring system as set forth in the claim 2 wherein at least one said vertical strut of said strutting assembly is provided with a hydraulic cylinder lodged within the connector piece of said strutting assembly to push apart said vertical struts against walls of a trench.

* * * * *